US005322193A

United States Patent [19]

Sunderland

[11] Patent Number: 5,322,193

[45] Date of Patent: Jun. 21, 1994

[54] TUBE DISPENSER AND METHOD FOR DISPENSING THE CONTENTS OF A COLLAPSIBLE TUBE

[76] Inventor: Howard F. Sunderland, 16392-G Gothard St., Huntington Beach, Calif. 92647

[21] Appl. No.: 986,721

[22] Filed: Dec. 8, 1992

[51] Int. Cl.[5] ..... B65D 35/32

[52] U.S. Cl. ..... 222/99; 222/100

[58] Field of Search ..... 222/1, 99, 100, 101, 222/103, 104, 97, 98

[56] References Cited

U.S. PATENT DOCUMENTS

| | | | |
|---|---|---|---|
| 1,941,631 | 1/1934 | Socoloff et al. | 222/97 |
| 1,986,409 | 1/1935 | Redmer | 222/99 |
| 3,088,632 | 5/1963 | Hickey | 222/100 |
| 3,628,696 | 12/1971 | Duiker | 222/99 |

FOREIGN PATENT DOCUMENTS

| | | | |
|---|---|---|---|
| 632915 | 10/1963 | Belgium | 222/99 |
| 1568182 | 4/1969 | France | 222/104 |
| 287053 | 3/1953 | Switzerland | 222/99 |
| 483894 | 4/1938 | United Kingdom | 222/99 |

*Primary Examiner*—Andres Kashnikow
*Assistant Examiner*—Philippe Derakshani
*Attorney, Agent, or Firm*—Timothy T. Tyson

[57] ABSTRACT

A tube dispenser 10 and a dispensing method for collapsible tubes 24 are disclosed for operation by one hand. The dispenser has a pistol-like handle 12 which allows a high torque to consistently be applied to the tube by the thumb, thereby dispensing the tube's contents rapidly and in a uniform bead.

15 Claims, 5 Drawing Sheets

FIG. 1
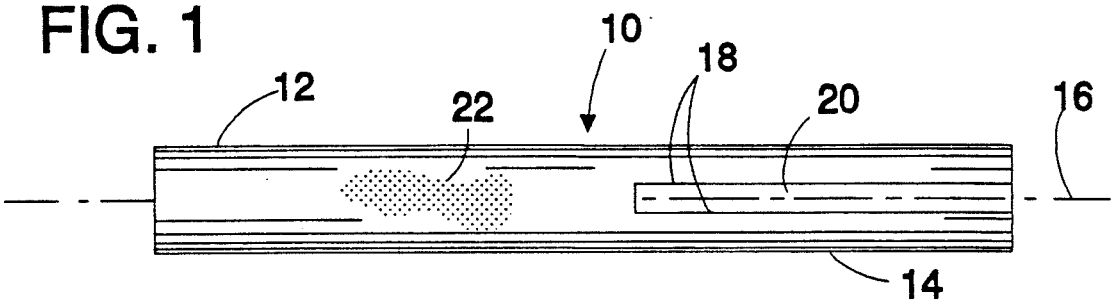
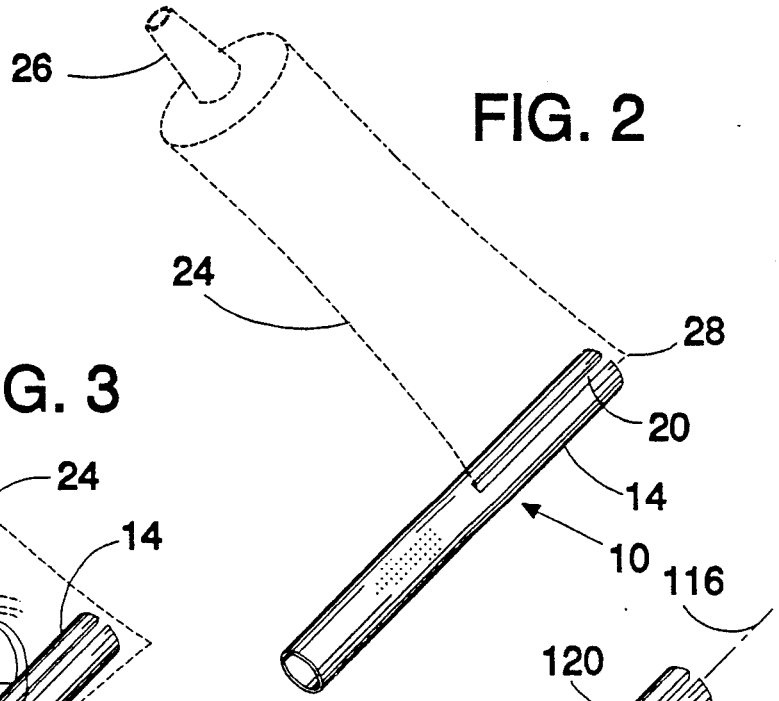
FIG. 2
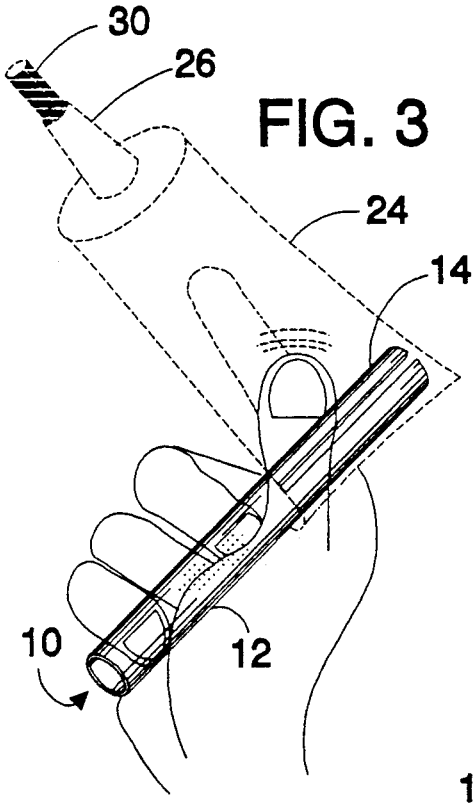
FIG. 3
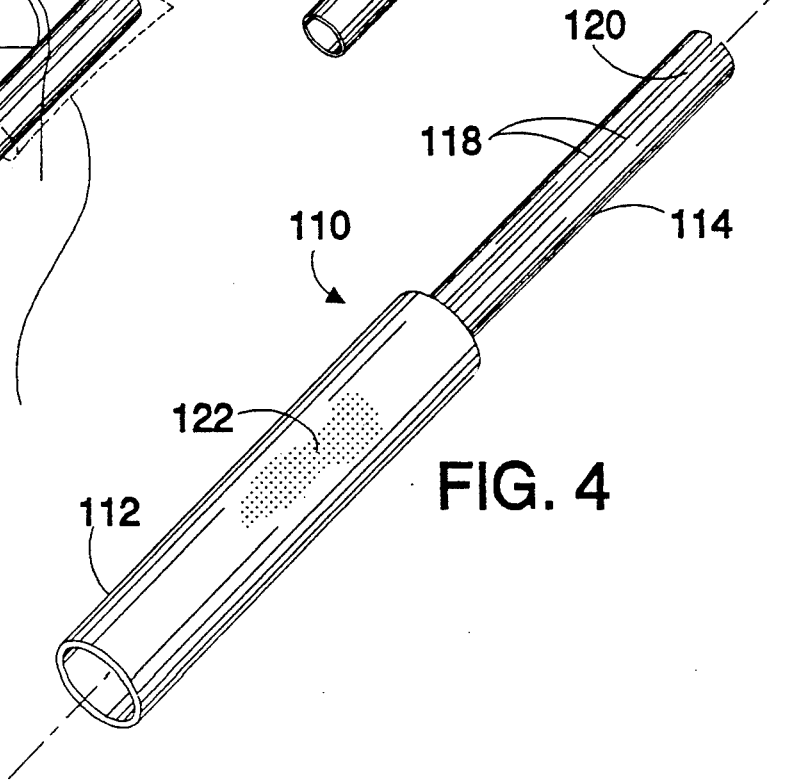
FIG. 4

150
150

150
160
140
140
140
10

150
24
10
160

242
244
240

232
254
236
238
246
234
256
235
242
240
258
220
218
214

252
210
230
222
224
234
214
248
212
260
216
232
250
230
210

224
210
246

TUBE DISPENSER AND METHOD FOR DISPENSING THE CONTENTS OF A COLLAPSIBLE TUBE

TECHNICAL FIELD

The present invention pertains to dispensers for dispensing the fluid contents of collapsible tube containers, and more particularly to a dispenser and method of dispensing which require the use of only one hand.

BACKGROUND ART

Devices for dispensing the contents of collapsible tubes have been known in the art for many years. Each of these previous devices utilizes some form of winding key or knob arrangement, operated by two hands, to dispense the contents of the collapsible tube by rotating the dispenser in the direction of the tube's neck. For example, U.S. Pat. Nos. 1,986,409, 1,990,929, 2,492,594, 4,570,828, and 4,653,670 all utilize the fundamental winding key concept. U.S. Pat. Nos. 3,473,698, 3,759,421, 3,885,708, and 4,576,314 add a tapered guide for compressing the tube as it is wound around the dispenser. U.S. Pat. No. 4,664,293 employees an anti-unwinding feature which is especially useful in dispensing the contents of plastic tubes.

In order to dispense the contents of the collapsible tube into a uniform bead, these prior art devices require the use of two hands to simultaneously hold and rotate the dispenser so as to maintain a constant pressure within the tube. It is quite difficult however to maintain this continuously even pressure while concurrently rotating the dispenser.

If only one hand is employed, it is almost impossible to dispense a uniform bead for a prolonged period of time. One reason for this is that it is extremely strenuous and tiring to maintain a constant pressure on the tube.

This is particularly true in the case of tubes containing thick fluids such as industrial caulks, sealers, glues and the like. Further, the contents tend to move in multiple directions within the tube as pressure is applied, thus requiring the application of even greater pressure over a larger surface area of the tube.

This movement problem is exacerbated when a significant portion of the contents of the tube is depleted. Additionally, only a small portion of the contents of the tube can be dispensed before the process must necessarily stop and the dispenser again be rotated toward the neck of the tube. Each of these factors can result in both a reduced and uneven discharge rate and the consequent lack of uniformity in the dispensed bead.

DISCLOSURE OF INVENTION

The present invention is directed to an improved tube dispenser and method for caulks, sealers, glues and the like, which can be operated with one hand, thus leaving the other hand free to perform additional tasks. One hand operation is accomplished by providing a pistol-like handle connected to a tube-wrapping mandrel. The closed end of a collapsible tube is inserted in a slot in the mandrel and then wrapped around the mandrel. The handle is grasped by the last three fingers of the hand while the thumb and index finger straddle the collapsible tube. A torque is then applied to the collapsible tube by the action of the last three fingers turning the handle, mandrel, and collapsible tube against the thumb. In this manner pressure may be exerted on the collapsible tube by the thumb thereby causing the contents of the collapsible tube to be dispensed.

In accordance with a preferred embodiment of the invention, both the handle and the mandrel are made from tubular casings, the casings having a substantially common longitudinal first axis. The diameter of the mandrel is less than the diameter of the handle, so that the torque applied to the collapsible tube by the mandrel is greater than the torque applied by the hand to the handle.

In accordance with a preferred embodiment of the invention, a tube retaining spring is placed around the tube dispenser. The tube retaining spring contains a shaft which holds the collapsible tube in place and prevents unwinding.

In accordance with another important aspect of the invention, the tube dispenser additionally contains a swing arm which rotates around the handle or mandrel. The swing arm has a first hole into which is inserted an elongated slide pin, so that the slide pin extends parallel to the first axis of the mandrel. When pressure is exerted on the swing arm by the thumb, the pin pushes against the collapsible tube and dispenses the collapsible tube's contents.

In accordance with a feature of the invention, the elongated slide pin may be connected to the swing arm at a different distance from the mandrel by insertion into a second hole in the swing arm. The second hole is closer than the first hole to the first axis of the mandrel, and therefore when the pin is inserted into the second hole the pin exerts a torque on the collapsible tube which is greater than the torque applied on the swing arm by the thumb.

In accordance with a preferred embodiment of the invention, a rotation limiter means is connected between the swing arm and the handle or mandrel. The rotation limiter means permits the swing arm to rotate around the handle or mandrel in a first direction only, and therefore prevents the collapsible tube from unwinding from the mandrel in a second direction opposite to the first direction.

In accordance with another important feature of the invention, the swing arm has a slot connecting the first and second holes. The slide pin has a key portion which fits into the slot and allows the slide pin to be moved from the first hole to the second hole. Additionally, the slide pin has caps that prevent the slide pin from disengaging from the swing arm.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a side view of the tube dispenser in accordance with the present invention;

FIG. 2 is a reduced perspective view of the tube dispenser with a collapsible tube installed;

FIG. 3 is a reduced perspective view of the tube dispenser showing the contents of the collapsible tube being dispensed;

FIG. 4 is a perspective view of a second embodiment;

MODES FOR CARRYING OUT THE INVENTION

Figures 5, 6A, 6B, 7:
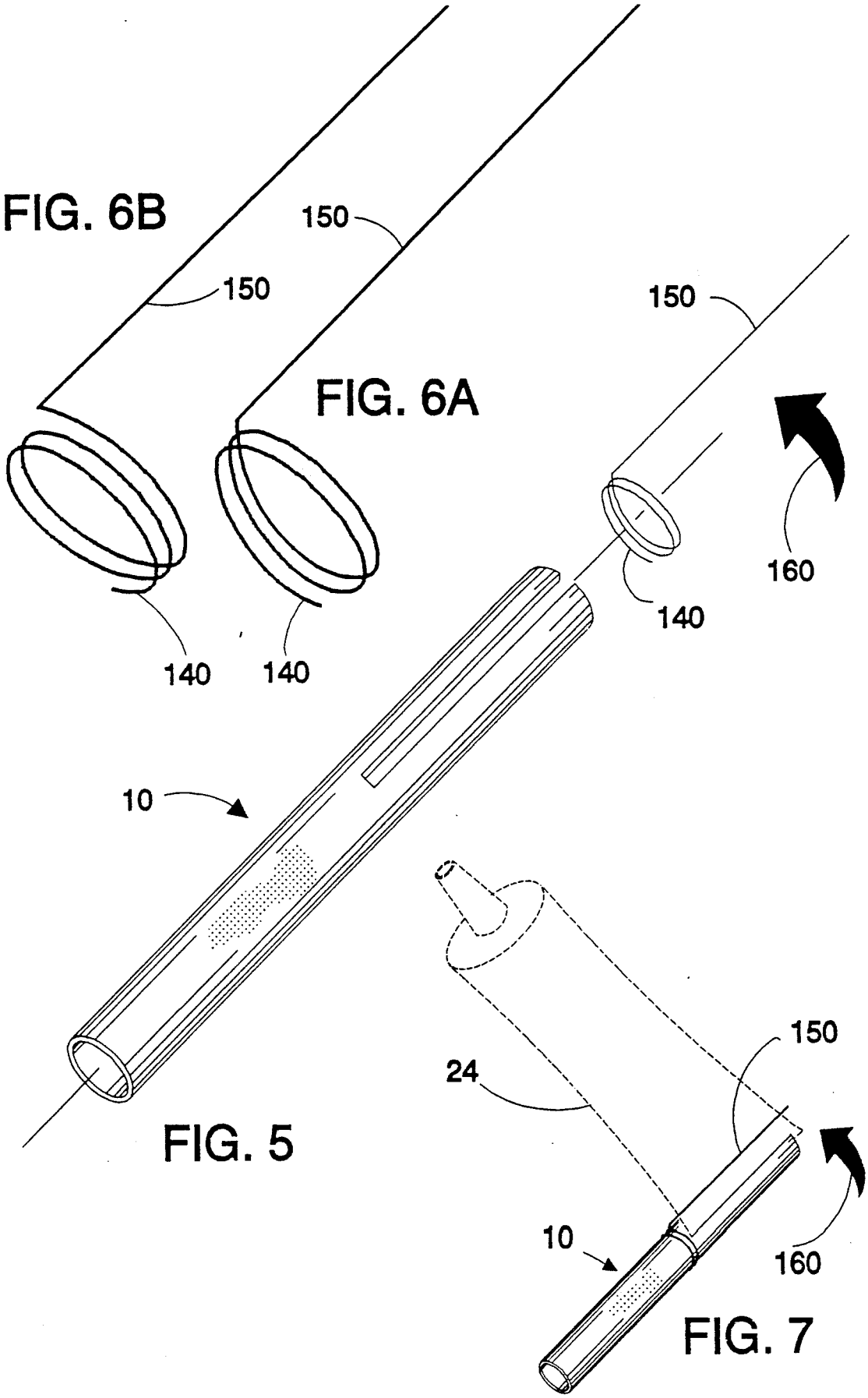
FIG. 5 is a perspective view of a third embodiment.
FIG. 6A is an enlarged perspective view of a right-handed retaining spring.
FIG. 6B is an enlarged perspective view of a left-handed retaining spring.
FIG. 7 is a reduced perspective view of the third embodiment showing the collapsible tube being held in place by the retaining spring.

Referring initially to FIG. 1, there is illustrated a side view of a tube dispenser for dispensing the contents of collapsible tubes in accordance with the present invention, generally designated as 10. The tube dispenser 10 consists of a handle 12 connected to a mandrel 14. The handle 12 has a length substantially equal to or greater than the width of a hand and is suitable for grasping between the fingers and the palm of the hand. The handle 12 and the mandrel 14 have a substantially common longitudinal first axis 16. The mandrel 14 has a second end opposite its first end, the second end having a receiving means for receiving the closed end of the collapsible tube. In the embodiment shown, the receiving means consists of a longitudinal slot 20, open at the outer end, formed by two walls 18 in the mandrel 14, the slot 20 sized to receive the closed end of the collapsible tube. A friction increasing surface 22 such as knurls is applied to the surface area of the handle 12 in order to increase the friction when the handle 12 is grasped by the last three fingers of the hand.

FIG. 2 is a reduced perspective view of the tube dispenser 10 showing a collapsible tube 24 installed. The closed end 28 of the collapsible tube is longitudinally inserted into the slot 20 in the mandrel 14. The collapsible tube 24 contains a dispensing neck portion 26 opposite to the closed end 28.

FIG. 3 is a reduced perspective view of the tube dispenser 10 showing the collapsible tube 24 wrapped around the mandrel 14. The handle 12 is grasped like a pistol grip with the last three fingers of the hand. The thumb and index finger straddle the collapsible tube 24 with the thumb exerting pressure on the collapsible tube 24 and thereby dispensing the contents 30 through the dispensing neck 26. The thumb and the index finger guide the location of the dispensed contents 30. The embodiment shown is for use with the righthand, however by wrapping the collapsible tube 24 around the mandrel 14 in the opposite direction, the lefthand can equally well be utilized.

The embodiment shown in FIGS. 1, 2 and 3 suggests that the handle 12 and the mandrel 14 are constructed from tubular casings. However, a solid material would be equally acceptable.

As shown in FIGS. 1, 2 and 3, the present invention overcomes the disadvantages of the prior art by permitting the continuous application of even pressure on the collapsible tube 24 and the resultant dispensing of the contents 30 in a uniform bead. This even pressure is made possible by the torque generated by the three fingers grasping the handle 12 and the thumb pressing against the collapsible tube 24. Furthermore, the use of this torquing action is much less strenuous than the conventional method of squeezing the collapsible tube 24 between the fingers and thumb because the whole hand is used instead of just the fingers. Also, the internal contents 30 of the collapsible tube 24 cannot move in multiple directions within the collapsible tube 24 as occurs when a tube is squeezed in the middle, but rather are continuously forced toward the neck of the tube 26, therefore resulting in a continuous pressure within the collapsible tube 24 and the consequent dispensing of a uniform bead. The high torque applied by the fingers and thumb result in a high pressure against the collapsible tube 24 and the contents of the tube 30 may therefore be dispensed in a short period of time with a minimum of effort. This ability to dispense the contents 30 of the collapsible tube 24 easily and uniformly in a short period of time is extremely beneficial in industrial applications. Further, the continuous pressure made possible by the present invention does not weaken the collapsible tube 24 as can result from the multiple flexings existent in the prior art. And, due to the continuous pressure that is applied by the thumb, plastic type collapsible tubes 24 will not be able to unwind from the mandrel 14.

FIG. 4 is a perspective view of a second embodiment of the tube dispenser, generally designated as 110. The tube dispenser 110 consists of a handle 112 connected to a mandrel 114. The handle 112 and the mandrel 114 have a substantially common longitudinal first axis 116. The mandrel 114 has a receiving means for receiving the closed end of a collapsible tube. In the embodiment shown, the receiving means consists of a longitudinal slot 120, open at the outer end, formed by two walls 118 in the mandrel 114. A friction increasing surface 122 such as knurls is applied to the surface area of the handle 112 in order to provide more friction when the handle 112 is grasped by the last three fingers of the hand. In this second embodiment, the diameter of the mandrel 114 is less than the diameter of the handle 112. Resultantly, when a torque is applied to the handle 112 that torque is multiplied and applied to the collapsible tube by the mandrel 114. In this fashion a mechanical advantage proportional to the ratio of the two diameters is achieved.

It will be appreciated that while the handle 112 and mandrel 114 shown are cylindrical, the cross sections perpendicular to the first axis may have other shapes such as square, star or irregular. As long as the cross section of the mandrel 114 is less than the cross section of the handle 112, the torque on the mandrel 114 will be greater than a given torque on the handle 112. A mechanical advantage of 2 to 1 has been found to be useful.

The tube dispensers 10 or 110 shown in FIG. 1 through FIG. 4 are used to dispense the contents of the collapsible tube 24 in the following manner. The closed end 28 of the collapsible tube 24 is inserted into the receiving means 20 or 120. The collapsible tube 24 is then wrapped around the mandrel 14 or 114 until the contents 30 press firmly against the collapsible tube 24. The tube dispenser is then grasped with one hand so that the thumb-and index finger straddle the collapsible tube 24 and the remaining three fingers wrap around and firmly grip the handle 12 or 112. The thumb is then utilized to exert pressure on the collapsible tube 24 thereby causing the contents to be dispensed. The thumb and index finger are further used to position the location of the dispensed contents 30.

FIG. 5 is a perspective view of a third embodiment. The third embodiment consists of the first embodiment to which has been added a tube retaining means. In the embodiment shown, the tube retaining means consists of a retaining spring 140 which is placed around the tube dispenser 10. The retaining spring 140 contains a shaft 150 which engages the collapsible tube 24 and prevents the collapsible tube 24 from unwinding from the tube dispenser 10 when thumb pressure is removed. The retaining spring 140 normally wraps tightly around the tube dispenser 10 and holds the installed collapsible tube 24 in place. The retaining spring 140 is released and rotated by pushing with the thumb in the direction of the arrow 160. Therefore, as the contents of the collapsible tube 24 are dispensed, the retaining spring 140 may be periodically rotated around the tube dispenser 10 so that the shaft 150 continues to engage the collapsible tube 24. The direction of rotation of the retaining spring 140 around the tube dispenser 10 is determined by the right or left-handedness of the retaining spring 140.

FIG. 6A is an enlarged perspective view of the right-handed retaining spring 140.

FIG. 6B shows a left-handed retaining spring 140 which is a mirror image of the right-handed retaining spring 140 shown in FIG. 6A. The left-handed retaining spring 140 is released and rotates in a direction exactly opposite to that of the right-handed spring shown in FIG. 6A.

FIG. 7 is a reduced perspective view of the third embodiment showing a collapsible tube 24 installed in the tube dispenser 10. The collapsible tube is held in place by the shaft 150 of the retaining spring 140, and is therefore prevented from unwinding from the tube dispenser 10. The retaining spring 140 is released and rotates in the direction of the arrow 160.

Figures 8, 9A, 9B, 10, 11:
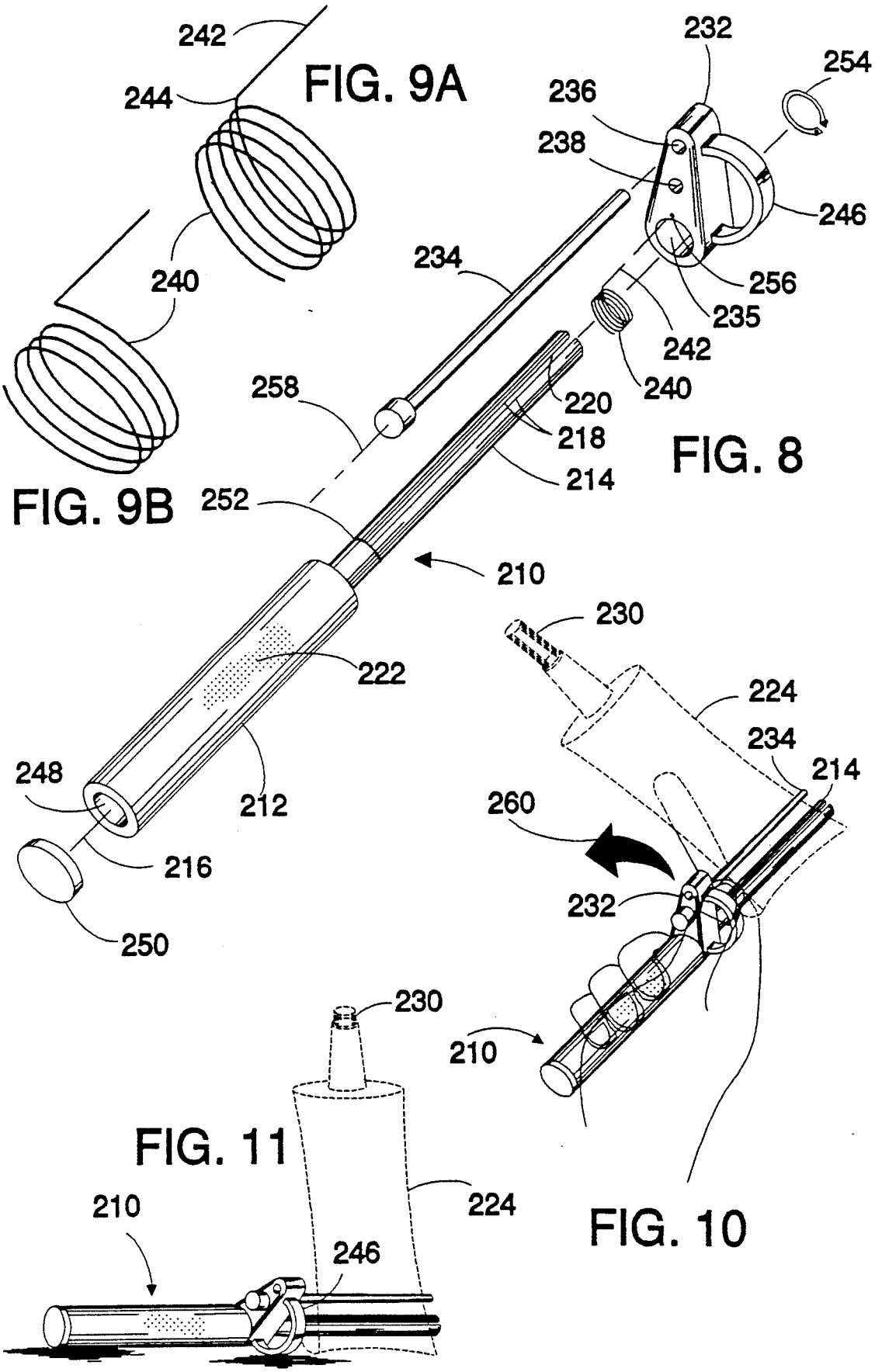
FIG. 8 is an exploded perspective view of a fourth embodiment.
FIG. 9A is an enlarged perspective view of a right-handed rotation limiter and rewinder spring.
FIG. 9B is an enlarged perspective view of a left-handed rotation limiter and rewinder spring.
FIG. 10 is a reduced perspective view of the fourth embodiment showing the contents of the collapsible tube being dispensed.
FIG. 11 is a reduced perspective view of the fourth embodiment showing the tube dispenser placed on a horizontal surface.

FIG. 8 is an exploded perspective view of a fourth embodiment of the tube dispenser, generally designated as 210. The fourth embodiment resembles the second embodiment previously shown in FIG. 4 in so far as the fourth embodiment consists of a handle 212 connected to a mandrel 214, having a first diameter, a substantially common longitudinal first axis 216, a receiving means consisting of a longitudinal slot 220, open at the outer end, formed by two walls 218, and a friction increasing surface 222 such as knurls applied to the surface area of the handle 212. The fourth embodiment however, adds certain additional elements that significantly enhance the operation of the tube dispenser 210 in certain applications A swing arm is included having a hole 235 which encircles and is free to rotate around the mandrel 214. A tube pusher means is connected to the swing arm 232. In the shown embodiment the tube pusher means consists of an elongated slide pin 234 which is connected to the swing arm 232 in a first position by insertion through walls defining a first hole 236 in the swing arm 232 so that the second axis of the slide pin 258 is substantially parallel to the first axis of the mandrel 216. The elongated slide pin 234 may also be inserted in walls defining a second hole 238 in the swing arm 232 and thereby be placed in a second position closer to the mandrel 214. By placing the elongated slide pin 234 closer to the mandrel 214, the elongated slide pin 234 exerts a greater torque around the mandrel 214, provided by the thumb pushing on the swing arm 232 in a position adjacent the first position, than when the elongated slide pin 234 is in the first hole 236. For example, if the second position is halfway between the first position and the first axis 216, when the thumb pushes on the swing arm 232 at the first position, the torque on the collapsible tube is doubled. When this multiplication is combined with the doubling of the torque caused by the difference in diameters of the handle 212 and mandrel 214, the torque is increased four times.

A rotation limiter and rewinder means is coupled between the mandrel 214 and the swing arm 232. In the shown embodiment the rotation limiter and rewinder means consists of a wrap spring 240 of a second diameter slightly less than the first diameter of the mandrel 214, with the wrap spring 240 being wrapped around the mandrel 214 in a position near the handle 212.

The wrap spring 240 has a longitudinally extending prong 242 which engages a third hole 256 in the swing arm 232, so that the swing arm 232 normally rotates around the mandrel 214 in one direction. The direction of rotation of the swing arm 232 around the mandrel 214 is determined by the right or left-handedness of the wrap spring 240.

FIG. 9A is an enlarged perspective view of the right-handed rotation limiter and rewinder spring 240. The wrap spring 240 normally wraps tightly around the mandrel 214 stopping any movement. The wrap spring 240 is released by pushing the swing arm 232 in a single direction around the mandrel 214. The swing arm 232 and wrap spring 240 thereafter rotate freely around the mandrel 214 in the single direction. The wrap spring 240 further contains a rewinder means. In the embodiment shown, the rewinder means consists of an elongated loop 244, having a third diameter larger than the second diameter of the wrap spring 240 and the first diameter of the mandrel 214, which biases the elongated longitudinal prong 242 to a slightly unwound position when thumb pressure is removed from the swing arm 232, thereby causing the swing arm 232 to unwind slightly in a direction opposite to the single direction. The purpose of the rewinder means is to remove pressure on the contents of the tube when the swing arm 232 is released in order to minimize unwanted movement of the tube's contents out of the tube.

FIG. 9B shows a left-handed wrap spring 240 which is a mirror image of the right-handed wrap spring 240 shown in FIG. 9A. The left-handed wrap spring shown in FIG. 9B limits and rewinds in directions exactly opposite to those of the right-handed spring shown in FIG. 9A.

In FIG. 8., a circular retaining groove 252 is provided in the mandrel 214 near the handle 212, so that the wrap spring 240 and the swing arm 232 may be held firmly in position around the mandrel 214 by retaining clamp 254 which securely engages the retaining groove 252. A cylindrical storage cavity 248 is provided in the handle 212 for the storage of an extra elongated slide pin 234. A cap 250 is removeably connected to the end of the handle 212 to keep the stored extra elongated slide pin 234 within the storage cavity 248.

FIG. 10 is a reduced perspective view of an assembled fourth embodiment showing the contents 230 of the collapsible tube 224 being dispensed. In this view collapsible tube 224 has been wrapped around the mandrel 214. Thumb pressure is applied to the swing arm 232 in the direction of the arrow 260 and coupled through the elongated slide pin 234 to the collapsible tube 224, thus causing the contents 230 to be dispensed. While FIG. 10 shows one collapsible tube 224 wrapped around the mandrel 214, it can easily be envisioned that the length of the mandrel 214 and the elongated slide pin 234 can be designed to accept more than one collapsible tube 224, and therefore dispense the contents 230 of multiple tubes simultaneously.

FIG. 11 is a reduced perspective view of the fourth embodiment showing the tube dispenser 210 placed on a horizontal surface. A stand 246 serves to balance the tube dispenser 210 in a stable state so that the attached collapsible tube 224 is maintained in an upright position, and therefore the contents 230 are less likely to discharge through gravity flow. The stand 246 is formed in a loop creating a thumb retaining means which allows the tube dispensed to be held by the thumb only.

Figure 12:
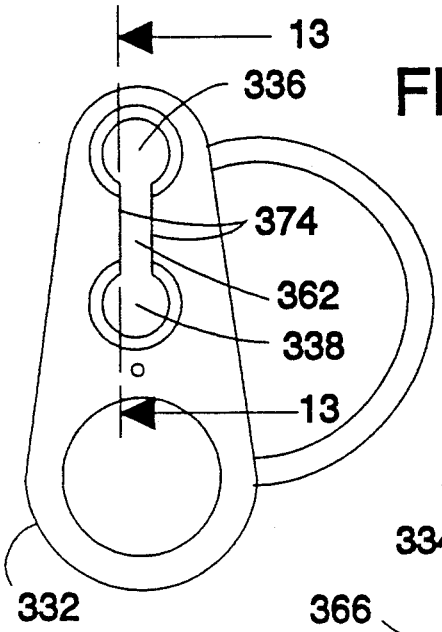
FIG. 12 is an enlarged end elevational view of an alternative configuration of the swing arm.
Figure 14:
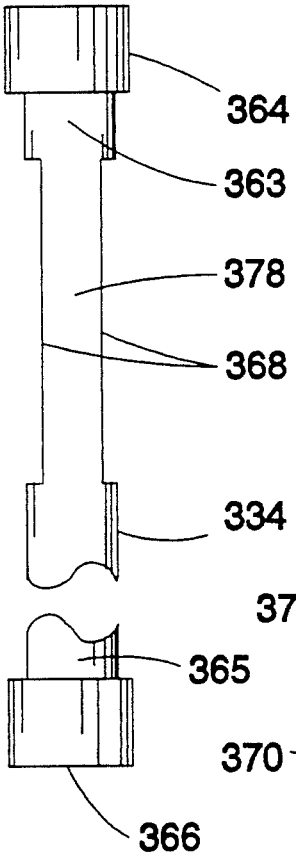
FIG. 14 is an enlarged top plan view of an alternative configuration of the slide pin.

FIG. 12 is an enlarged end elevational view of an alternative configuration of the swing arm, designated as 332. In this configuration, swing arm 332 has an adjustment slot 362 formed by two parallel walls 374. The slot 362 extends between the first position 336 and the second position 338. The slot 362 allows a modified slide pin 334, as shown in FIG. 14, to be moved between the first and second positions as desired, without removing the slide pin 334 from the swing arm 332. This feature allows the slide pin 334 to be permanently attached to the tube dispenser thereby eliminating the possibility that the slide pin 334 might become lost as is possible with the slide pin 234 of FIG. 8.

Figure 13:
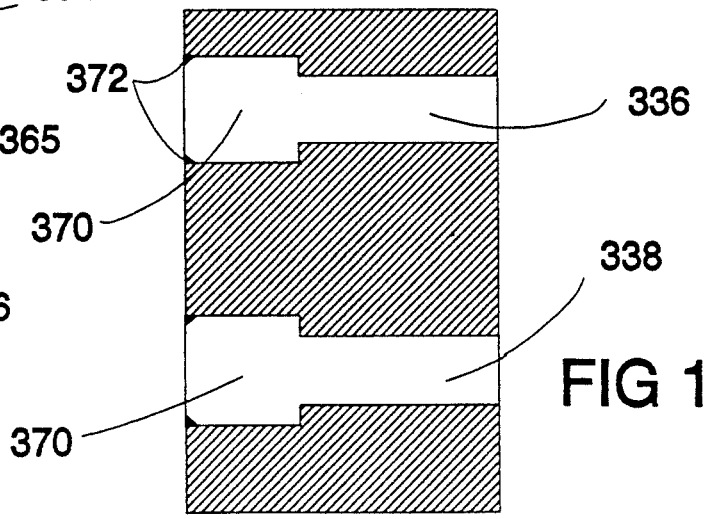
FIG. 13 is a cross sectional view of the alternative configuration of the swing arm along the line 13—13 of FIG. 12.

FIG. 13 is a cross sectional view of the swing arm 332, along the line 13–13 of FIG. 12, showing that the swing arm 332 has countersunk cavities 370 in both the first position 336 and the second position 338. Each of the countersunk cavities 370 have a lip 372 which forms a pin retaining means.

FIG. 14 is an enlarged top plan view of the alternative configuration of the slide pin, designated as 334. The slide pin 334 has a first end 363 and a second end 365. Near the first end 363, the slide pin 334 has been milled to remove material to form a key 378 having two parallel sides 368. The width of the key 378 is slightly less than the width of the slot 362 in the swing arm 332, so that the key 378 may be inserted into the first position 336 or the second position 338 and then freely moved between the two positions. The slide pin 334 further has an end cap 364 and a breech cap 366. The two caps 364 and 366 prevent the slide pin 334 from disconnecting from the swing arm 332. Additionally, the breech cap 366 is sized to fit into the countersunk cavities 370 in the first and second positions 336 and 338 shown in FIGS. 12 and 13. The lip 372 locks the breech cap 366 in place within the cavity 370. The breech cap 366 may be unlocked from the cavity 370 through the application of longitudinal force upon the slide pin 334.

Figure 15A:
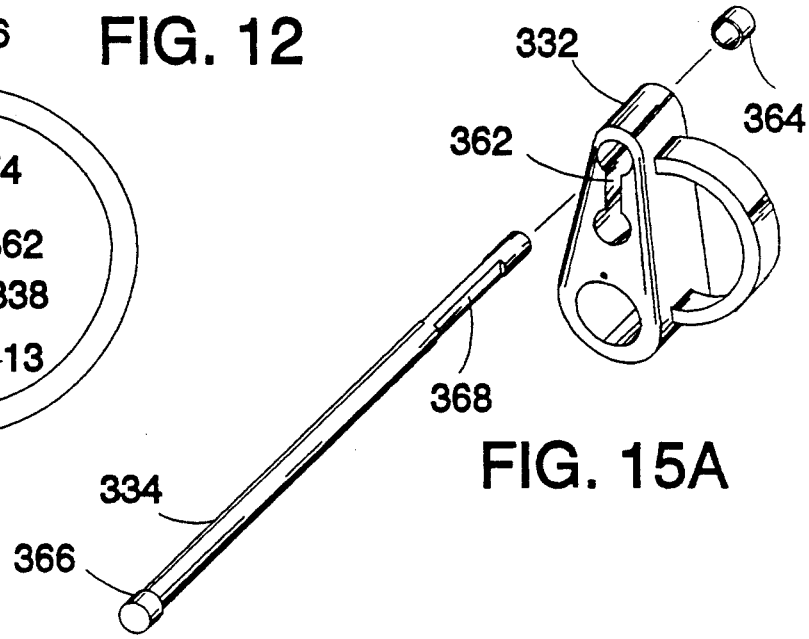
FIG. 15A is an exploded perspective view of a right-handed alternative configuration swing arm and slide pin.
Figure 15B:
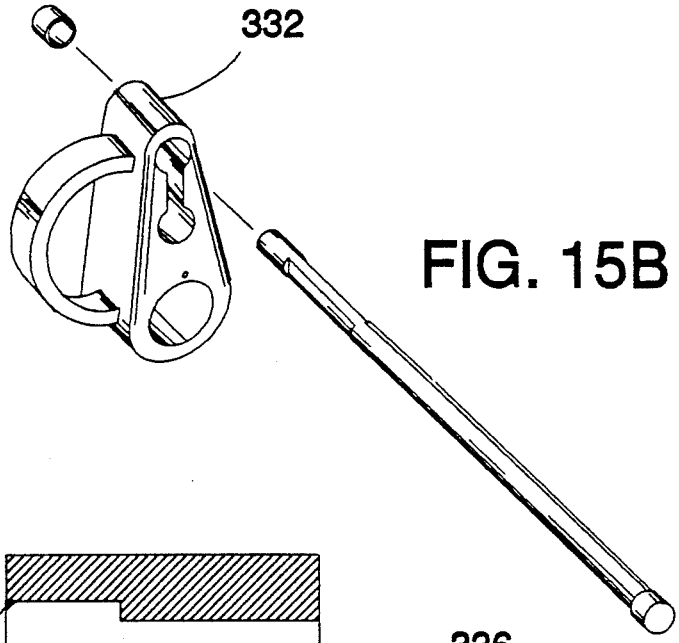
FIG. 15B is an exploded perspective view of a left-handed alternative configuration swing arm and slide pin.

FIG. 15A shows an exploded perspective view of a . . . right . . . right handed swing arm 332 with slide pin 334 being installed in the first position 336. FIG. 15B shows an exploded perspective view of a left-handed swing arm 332 with slide pin 334 being installed in the first position 336.

Figure 16:
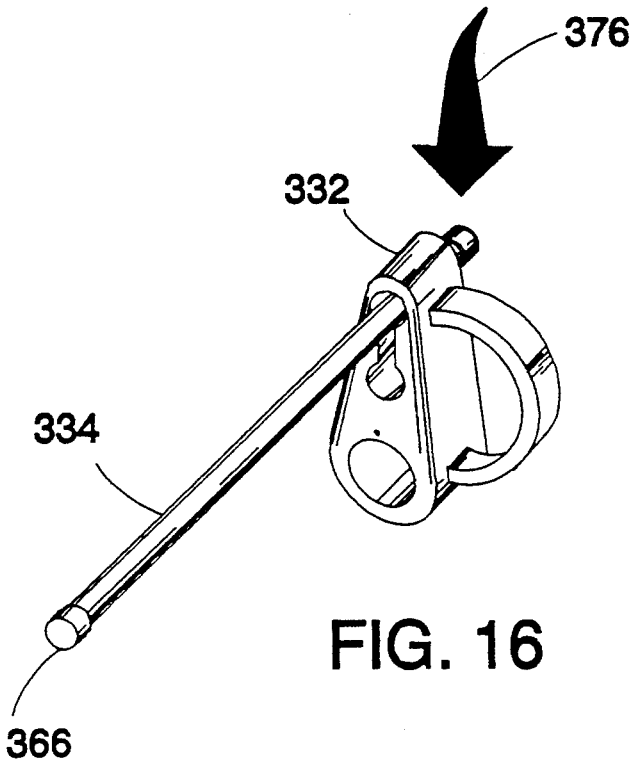
FIG. 16 is a perspective view of a slide pin inserted into the first position of the swing arm; and, FIG. 17 is a perspective view of a slide pin moved to the second position of the swing arm.

FIG. 16 shows the slide pin 334 installed in the first position 336 in such a location that the key 378 in the slide pin 334 is aligned with the slot 362 in the swing arm 332. By applying force in the direction of the arrow 376, the slide pin 334 may be moved from the first position to the second position.

Figure 17:
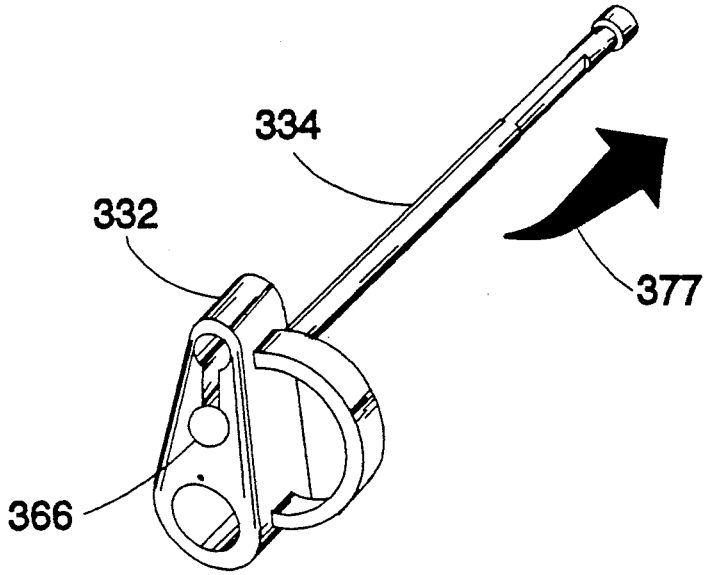

FIG. 17 shows the slide pin 334 moved to the second position 338 in the direction of the arrow 377 so that the breech cap 366 is locked in place by the lip 372 (FIG. 13).

The tube dispenser 210 shown in FIGS. 8–17 is used to dispense the contents of the collapsible tube 24 in the following manner. The closed end of the collapsible tube 224 is inserted into the receiving means 220. The collapsible tube 224 is then wrapped around the mandrel 214 until the contents press firmly against the collapsible tube 224, and the swing arm 232 is pushed toward the tube so that the tube pusher means 234 presses on the collapsible tube 224. The tube dispenser 210 is then grasped with one hand so that the thumb contacts the swing arm 232, the index finger contacts the collapsible tube 224, and the remaining three fingers wrap around and firmly grip the handle 212. When the thumb presses against the swing arm 232 it causes the pusher means 234 to press on the collapsible tube 224 and the contents 230 to be dispensed therefrom. The thumb and the index finger are used to position the location of the dispensed contents 230. Further, as shown in FIGS. 16 and 17, the slide pin 334 is moved to different positions on the swing arm 332 to provide the best leverage required to dispense the contents of the tube.

From the foregoing it should now be recognized that a tube dispenser and method for dispensing the contents of a collapsible tube have been disclosed herein. The preferred embodiments of the invention described herein are exemplary and numerous modifications, dimensional variations and rearrangements can be readily envisioned to achieve an equivalent result, all of which are intended to be embraced within the scope of the appended claims.

I claim:

1. A tube dispenser for dispensing the contents of a collapsible tube, comprising:

a handle having a length substantially equal to or greater than the width of a hand and suitable for grasping between the last three fingers and the palm of the hand so that the last three fingers surround said handle in a direction substantially perpendicular to said length of said handle;

a mandrel having a first end integral with said handle, said mandrel having a second end opposite to said first end;

a swing arm having a hole sized to receive said mandrel, said swing arm installed on said mandrel, said swing arm rotating around said mandrel and said longitudinal axis, and the thumb contacting said swing arm;

a tube pusher means coupled to said swing arm;

said mandrel having a receiving means at said second end to receive the closed end of the collapsible tube, so that the collapsible tube may be inserted into and then wrapped around said mandrel; and, said handle and said mandrel having a substantially common longitudinal axis;

whereby, said tube pusher means pushes the collapsible tube when said swing arm is pushed by the thumb.

2. A tube dispenser according to claim 1, wherein said tube pusher means includes an elongated slide pin having a second axis, said elongated slide pin being coupled to said swing arm at a first position with said second axis substantially parallel with said first axis.

3. A tube dispenser according to claim 2, wherein said swing arm further includes a second position on said swing arm between said first position and said first axis for connecting said elongated slide pin closer to said first axis than when connected in said first position, whereby the torque applied by said elongated slide pin on the collapsible tube is a multiple of the torque applied by the thumb pushing on said swing arm in a position adjacent to said first position.

4. A tube dispenser according to claim 3, wherein:

said swing arm further includes an adjustment slot formed by two parallel walls, said adjustment slot connecting said first position with said second position; and, said slide pin has a first end and a second end opposite to said first end, and further includes a key being sized to fit through said adjustment slot so that said slide pin may be inserted into said first position or into said second position and then moved between said positions through said adjustment slot.

5. A tube dispenser according to claim 4, wherein said slide pin further includes an end cap connected to said first end and a breech cap connected to said second end, so that said slide pin cannot be disconnected from said swing arm.

6. A tube dispenser according to claim 5, wherein said first position and said second position each further include a pin retaining means for holding said slide pin in said first or second position, and said breech cap is held coupled to said swing arm in one of the said first or second positions by said pin retaining means.

7. A tube dispenser according to claim 1, further comprising a rotation limiter means coupled between said swing arm and said mandrel for limiting the rotation of said swing arm to a single direction about said mandrel when force is applied to said swing arm.

8. A tube dispenser according to claim 7, wherein said mandrel has a first diameter and said rotation limiter means includes a wrap spring mounted on said mandrel and having a second diameter less than said first diameter and a longitudinally extending prong coupled to said swing arm.

9. A tube dispenser according to claim 8, further comprising a rewinder means coupled between said swing arm and said mandrel for rewinding said swing arm in a direction opposite to said single direction for releasing pressure on the collapsible tube.

10. A tube dispenser according to claim 9, wherein said rewinder means includes said wrap spring having an elongated loop with a third diameter greater than said first diameter of said mandrel for allowing said wrap spring to unwind slightly when thumb pressure is removed from said swing arm thereby causing said swing arm to rewind slightly.

11. A tube dispenser according to claim 1, wherein said swing arm, further comprises a stand for holding the collapsible tube upright when said tube dispenser is placed on a horizontal surface.

12. A method for dispensing the contents of a collapsible tube, comprising the steps of:

providing a tube dispenser, said tube dispenser having a handle, a mandrel, a swing arm, a receiving means for receiving the closed end of the collapsible tube, a rotation limiter means for limiting the rotation of said swing arm to a single direction, a rewinder means for causing said swing arm to unwind slightly in a direction opposite to the single direction, and a tube pusher means;

inserting the closed end of the collapsible tube into said receiving means;

wrapping the collapsible tube around said mandrel until the contents press firmly against the collapsible tube;

coupling said tube pusher means to said swing arm and rotating said swing arm so that said tube pusher means presses on the collapsible tube;

grasping said tube dispenser with one hand so that the thumb contacts said swing arm, the index finger contacts the collapsible tube, and the remaining three fingers wrap around and firmly grip said handle;

pressing the thumb against said swing arm thereby causing said pusher means to press on the collapsible tube and the contents to be dispensed therefrom; and, using the thumb and the index finger to position the location of the dispensed contents.

13. The method according to claim 12, further comprising the steps of:

providing said tube dispenser with a stand; and, standing said tube dispenser on said stand with the collapsible tube pointed upward to minimize leakage of the contents from the collapsible tube.

14. The method according to claim 13, further comprising the steps of:

providing said swing arm with an adjustment slot connecting a first and a second position;

providing said slide pin with a key; and, moving said slide pin through said adjustment slot to said desired first or second position.

15. A tube dispenser for dispensing the contents of a collapsible tube, comprising:

a handle having a length substantially equal to or greater than the width of a hand and suitable for grasping between the last three fingers and the palm of the hand so that the last three fingers surround said handle in a direction substantially perpendicular to said length of said handle and the thumb and the index finger straddle the collapsible tube;

a mandrel having a first end integral with said handle, said mandrel having a second end opposite to said first end;

said mandrel having a receiving means at said second end to receive the closed end of the collapsible tube, so that the collapsible tube may be inserted into and then wrapped around said mandrel;

a retaining spring connected around said tube dispenser and engaging the collapsible tube so that the collapsible tube does not unwind from said mandrel; and, said handle and said mandrel having a substantially common longitudinal axis;

whereby, when said handle is grasped with the hand, pressure may be exerted upon the collapsible tube by the thumb thereby causing the contents of the collapsible tube to be dispensed therefrom.

* * * * *